US006070726A

United States Patent [19]

Graham

[11] Patent Number: 6,070,726

[45] Date of Patent: Jun. 6, 2000

[54] PALLET AND CONTAINER INCLUDING PALLET

[75] Inventor: Steven Edward Graham, Clarkston, Mich.

[73] Assignee: Graham Creative Packaging, Rochester, Mich.

[21] Appl. No.: 09/128,007

[22] Filed: Aug. 3, 1998

[51] Int. Cl.[7] ..... B65D 19/20

[52] U.S. Cl. ..... 206/386; 108/51.3; 108/56.1

[58] Field of Search ..... 108/51.3, 56.1, 108/57.31, 57.33; 206/596, 599, 600, 386

[56] References Cited

U.S. PATENT DOCUMENTS

| | | | |
|---|---|---|---|
| 3,302,593 | 2/1967 | Roberts . | |
| 3,552,328 | 1/1971 | Sulliven | 108/51.3 |
| 3,568,912 | 3/1971 | Simas . | |
| 3,628,469 | 12/1971 | Neitzke | 108/51.3 |
| 3,697,029 | 10/1972 | Lauffer . | |
| 3,797,727 | 3/1974 | Downing et al. . | |
| 3,911,834 | 10/1975 | Quaintance | 108/51.3 |
| 3,995,736 | 12/1976 | Lawson et al. | 206/596 |
| 4,030,600 | 6/1977 | Heaps . | |
| 4,085,847 | 4/1978 | Jacalone | 206/600 |
| 4,898,321 | 2/1990 | Delany | 206/599 |
| 5,465,672 | 11/1995 | Boyse et al. | 108/51.3 |
| 5,517,926 | 5/1996 | Young, Jr. | 108/51.3 |
| 5,592,885 | 1/1997 | Young, Jr. et al. | 108/51.3 |
| 5,603,258 | 2/1997 | Besaw | 108/51.3 |
| 5,809,903 | 9/1998 | Young, Jr. | 108/51.3 |

*Primary Examiner*—Bryon P. Gehman
*Attorney, Agent, or Firm*—Young & Basile, P.C.

[57] ABSTRACT

A corrugated cardboard pallet usable either by itself or as the base member of a palletized container. The pallet includes a tray having side walls and a bottom wall; a plurality of blocks positioned within the tray proximate the side walls at spaced locations about the periphery of the side wall and each having a bottom face position on the bottom wall of the tray and an upper face lying in a common plane with the upper faces of other blocks; and a panel positioned within the side walls on top of the blocks. A plurality of flaps are provided in the side walls of the tray and the flaps, following placement of the panel within the side walls over the blocks, are folded upwardly and inwardly out of the side walls between adjacent blocks against the underface of the panel and secured to the underface of the panel. The flaps provide openings in the side walls for the entry of the tines of a material handling device and lock the side walls to the panel while retaining portions of the side walls in outwardly protecting relation to each block so as to discourage dislodgement of the blocks by material handling equipment.

21 Claims, 4 Drawing Sheets

14
12
16f
16b
16i
16d
18
16i
16f
12
16a
16g
16f
16d
16b
10
16i
16g
16g
16i
16g
16i
16g
16i
16g

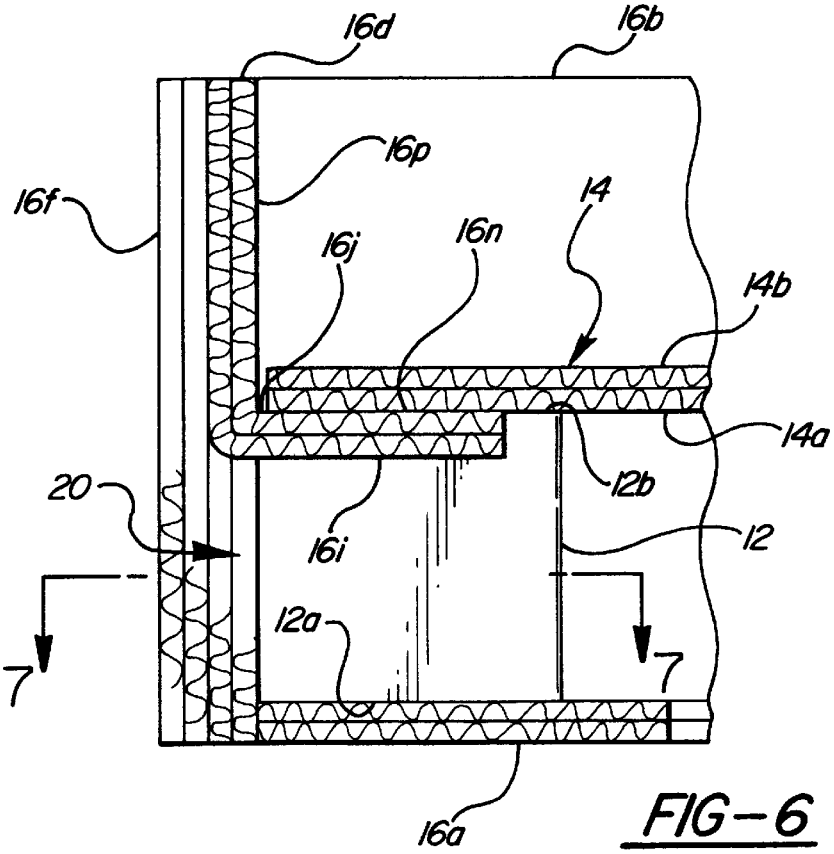
FIG-6
FIG-7
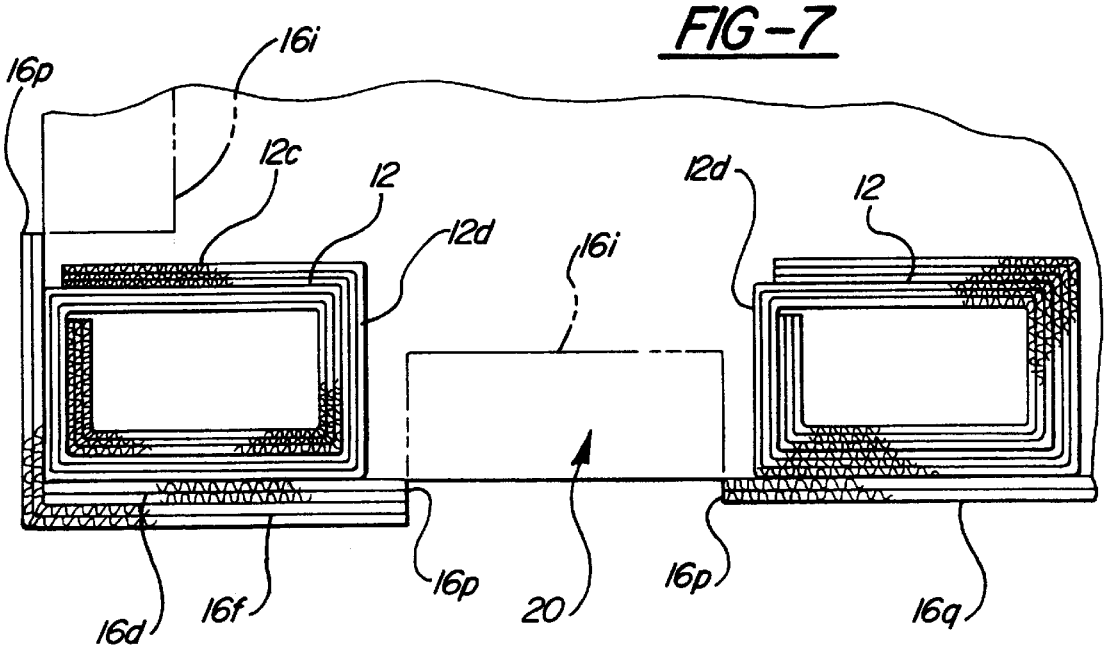

PALLET AND CONTAINER INCLUDING PALLET

BACKGROUND OF THE INVENTION

This invention relates to pallets and more particularly to pallets formed of a corrugated cardboard material. The invention further relates to a container utilizing the pallet of the invention as a base and yet further relates to a method of forming a pallet.

Pallets have been formed of wood, plastic, corrugated cardboard, and other materials. As compared to wood pallets, corrugated cardboard pallets avoid the liability problems relating to slivers and nails, are extremely lightweight and therefore relatively easy to move about, and may be readily recycled in a grinding operation. As compared to plastic pallets, corrugated cardboard pallets are relatively inexpensive and are relatively lightweight and therefore relatively easy to move around, and are readily recycled by grinding. However, corrugated cardboard pallets in general provide less strength and rigidity than plastic or wooden pallets and therefore are limited in their use to relatively small and/or relatively lightweight items. In an effort to improve the strength and rigidity of corrugated cardboard pallets, the pallets have been constructed utilizing a lower corrugated sheet; a plurality of corrugated blocks glued in upstanding fashion to the sheet with a block at each corner and intermediate blocks along each side of the sheet; an upper corrugated sheet positioned over and glued to the tops of the upstanding blocks; and a tray formed from a further corrugated sheet and positioned on top of the upper sheet to form the final pallet. Whereas this construction provides excellent strength and rigidity to the pallet, the blocks are totally exposed and as a result and are often knocked loose by material handling equipment such as forklift trucks, pallet jacks or the like with the result that the pallet collapses. Since these pallets are most typically used to form the base of a container with a sleeve positioned between the side walls of the tray and a lid closing the top of the sleeve, collapsing of a pallet in a stack of containers has disastrous results with respect to the entire stack.

SUMMARY OF THE INVENTION

The invention is directed to the provision of an improved pallet.

More specifically, this invention is directed to the provision of a pallet formed from corrugated cardboard material and having improved strength and rigidity and improved resistance to material handling damage.

This invention is further directed to the provision of an improved container utilizing the corrugated cardboard pallet of the invention and is yet further directed to a methodology of forming the corrugated cardboard pallet.

The pallet of the invention comprises a tray having side walls and a bottom wall; a plurality of block members positioned within the tray proximate the side walls at spaced locations about the periphery of the side walls and each having a bottom face positioned on the bottom wall of the tray and an upper face lying in a common plane with the upper faces of the other blocks; a panel positioned within the side walls on top of the blocks; and a plurality of flaps folded upwardly and inwardly out of the side walls between adjacent blocks against the underface of the panel and secured to the underface of the panel. The upwardly folded flaps provide openings in the side walls of the pallet for entry of material handling equipment and lock the side walls to the panel while retaining portions of the side walls in outwardly protecting relation to each block so as to discourage damage or dislodgement of the blocks during material handling operations.

According to a further feature of the invention, the blocks have a height less than the height of the side walls so that upper side wall portions extend above the level of the panel. With this arrangement the pallet may be utilized as an open top shallow container with materials positioned on the panel and precluded from inadvertent dislodgement by the side walls.

According to a further feature of the invention, the tray has a rectangular configuration defining four side walls and four corners; a corner block is positioned in each corner of the tray and an intermediate block is positioned proximate each side wall at an intermediate location along the side wall; and a flap is folded upwardly between each corner block and each intermediate block. The arrangement provides two openings in each side wall for the entry of the tines of material handling equipment and yet continues to provide protection for the blocks.

According to a further feature of the invention, the tray is formed of a corrugated cardboard material and each flap is formed in a side wall of the tray by a crease along a lower edge of the flap and slits along other edges of the flap whereby to allow the flap to be folded upwardly about the crease into engagement with the underface of the panel. The use of corrugated cardboard as the material of the tray facilitates the formation of the flaps as well as the upwardly folding movement of the flaps.

According to a further feature of the invention, the pallet of the invention is utilized as the base of a palletized container including a sleeve positioned on the pallet and a lid position over the sleeve.

The invention also provides a methodology for forming a pallet. According to the invention methodology, a tray is formed having side walls and a bottom wall; a plurality of blocks are positioned within the tray proximate the side walls at spaced locations about the periphery of the side walls with each block having a bottom face position on the bottom wall of the tray and an upper face lying in a common plane with the upper faces of the other blocks; the bottom faces of the blocks are secured to the bottom wall of the tray; a panel is positioned within the side walls on top of the blocks; the panel is secured to the upper faces of the blocks; the side walls of the tray are creased and slit to provide a plurality of upwardly foldable flaps between adjacent blocks; the flaps are folded upwardly and inwardly out of the side walls against the underface of the panel; and the flaps are secured to the underface of the panel. This methodology provides an efficient and inexpensive process for forming a corrugated cardboard pallet having excellent strength and rigidity and having means to preclude damage to the pallet.

In the disclosed embodiment of the invention, the panel is also formed of a corrugated cardboard material and each block is formed of a corrugated cardboard material wrapped to form a hollow rectangular laminated structure.

BRIEF DESCRIPTION OF THE DRAWINGS

FIG. 6 is a cross-sectional view taken on line 6—6 of FIG. 1; and FIG. 7 is a cross-sectional view taken on line 7—7 of FIG. 6.

DETAILED DESCRIPTION OF THE PREFERRED EMBODIMENT

Figure 1:
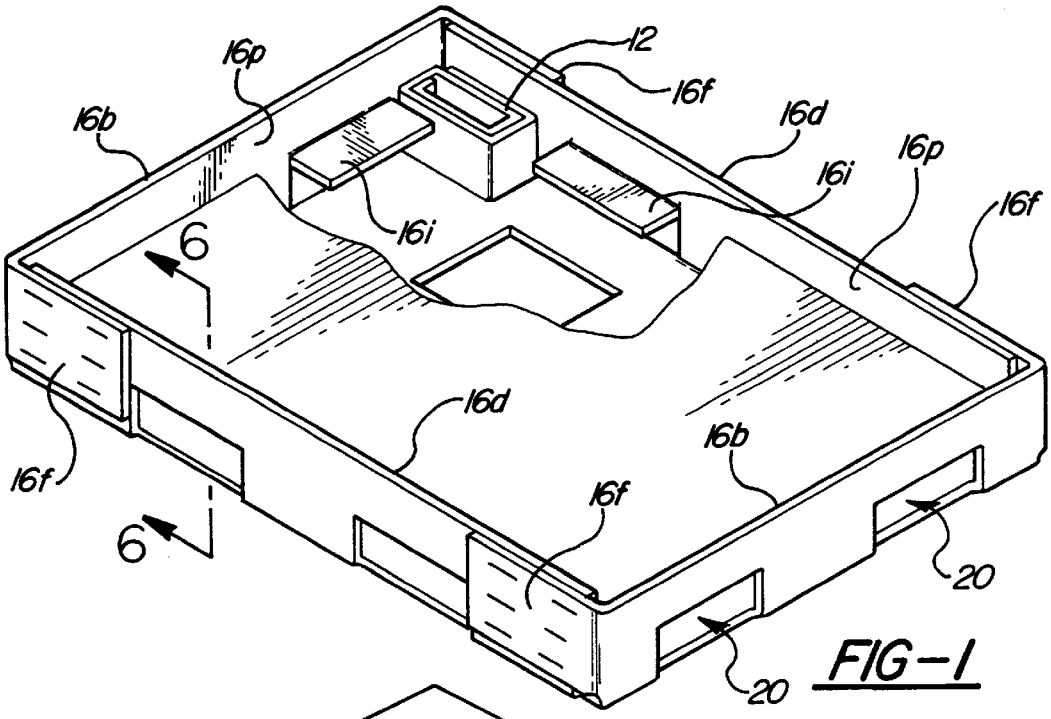
FIG. 1 is a perspective view of a corrugated cardboard pallet constructed in accordance with the invention.
Figure 2:
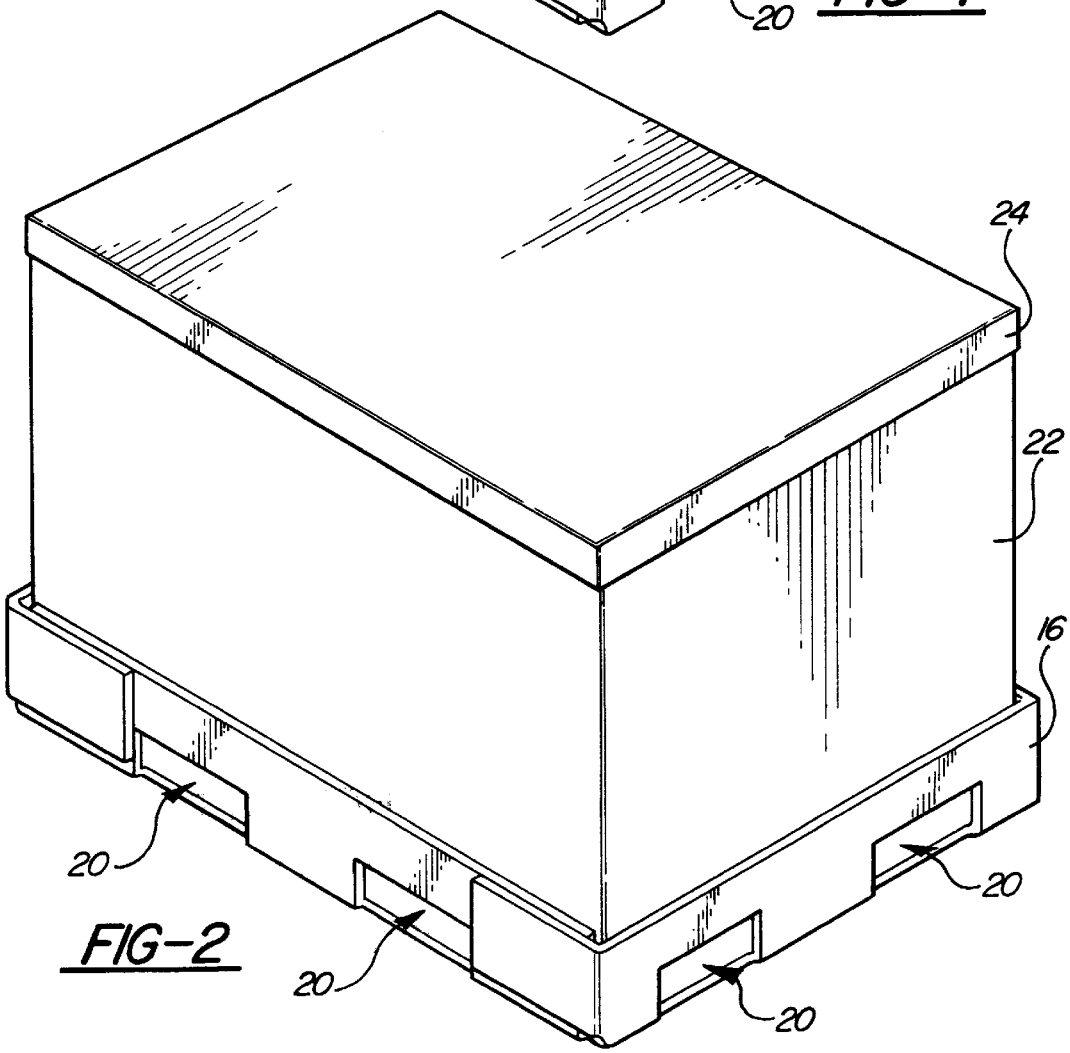
FIG. 2 is a palletized container utilizing the pallet of FIG. 1 is the base of the container.

A corrugated cardboard pallet according to the invention is seen in perspective view in FIG. 1 and a container utilizing the corrugated cardboard pallet of the invention as a base for the container is seen in FIG. 2.

The invention pallet, broadly considered, includes a tray 10, a plurality of blocks 12, and a panel 14, all preferably formed of a corrugated cardboard material.

Figure 5:
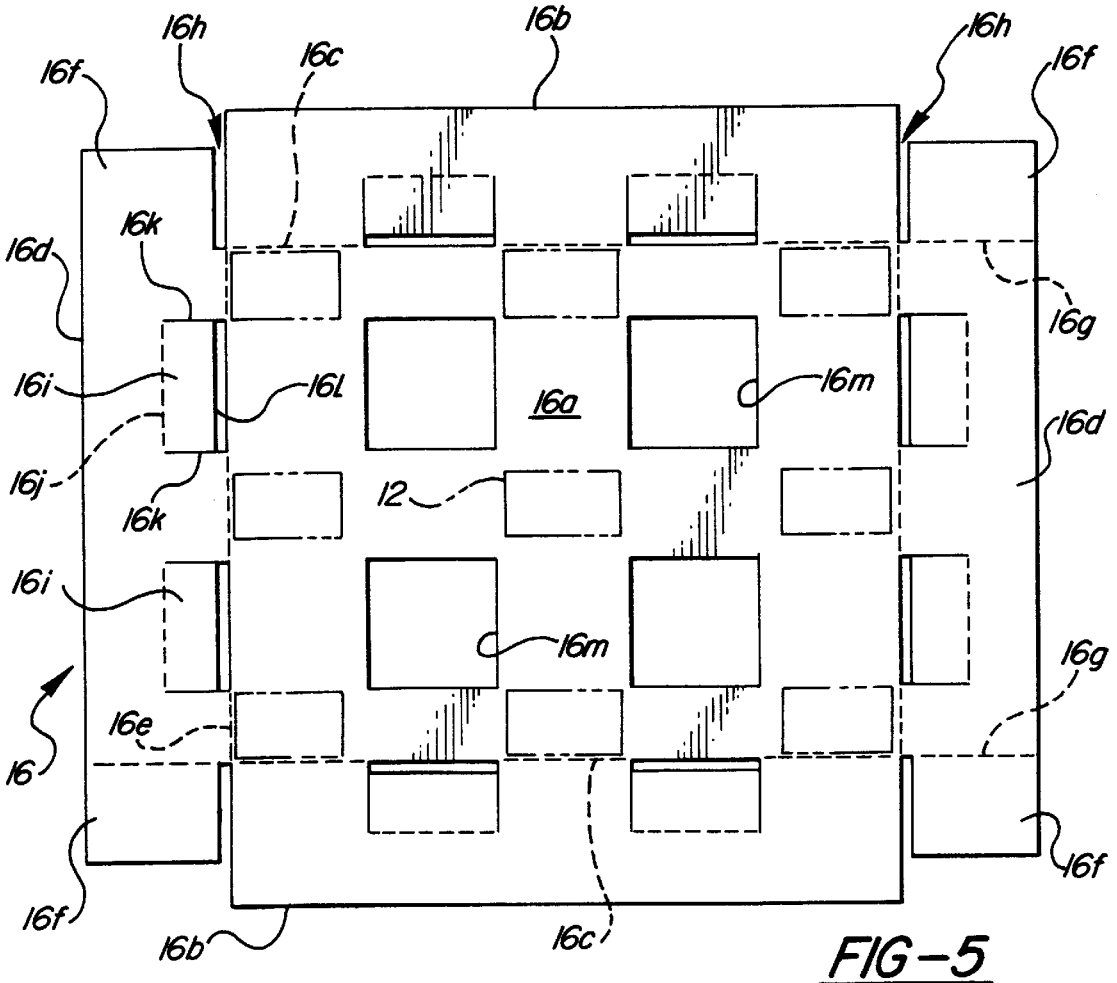
FIG. 5 is a plan view of a corrugated cardboard blank utilized in the formation of the invention pallet.

Tray 10 is formed from a blank 16 (FIG. 5) of double wall corrugated cardboard material and defines a generally rectangular bottom wall portion 16*a*, a pair of opposite side wall portions 16*b* delineated from main body portion 16*a* by crease or score lines 16*c*, a pair of opposite side wall portions 16*d* delineated from main body portion 16*a* by crease or score lines 16*e*, and end flaps 16*f* provided at each end of each side wall portion 16*d* delineated from the adjacent side walls 16*d* by score or crease lines 16*g* and separated from adjacent side walls 16*b* by slits 16*h*. A pair of spaced side wall flaps 16*i* is provided in each side wall 16*b*, 16*d*. Each side wall flap 16*i* is delineated from the associated side walls 16*b*,16*d* by a score or crease line 16*j*, is separated from the associated side wall 16*b*, 16*d* by laterally spaced slits 16*k*, and is separated from the adjacent portion of bottom wall portion 16*a* by a slot 161. Blank 16 further defines a plurality of rectangular openings 16*m* in bottom wall portion 16*a*.

Figure 4:
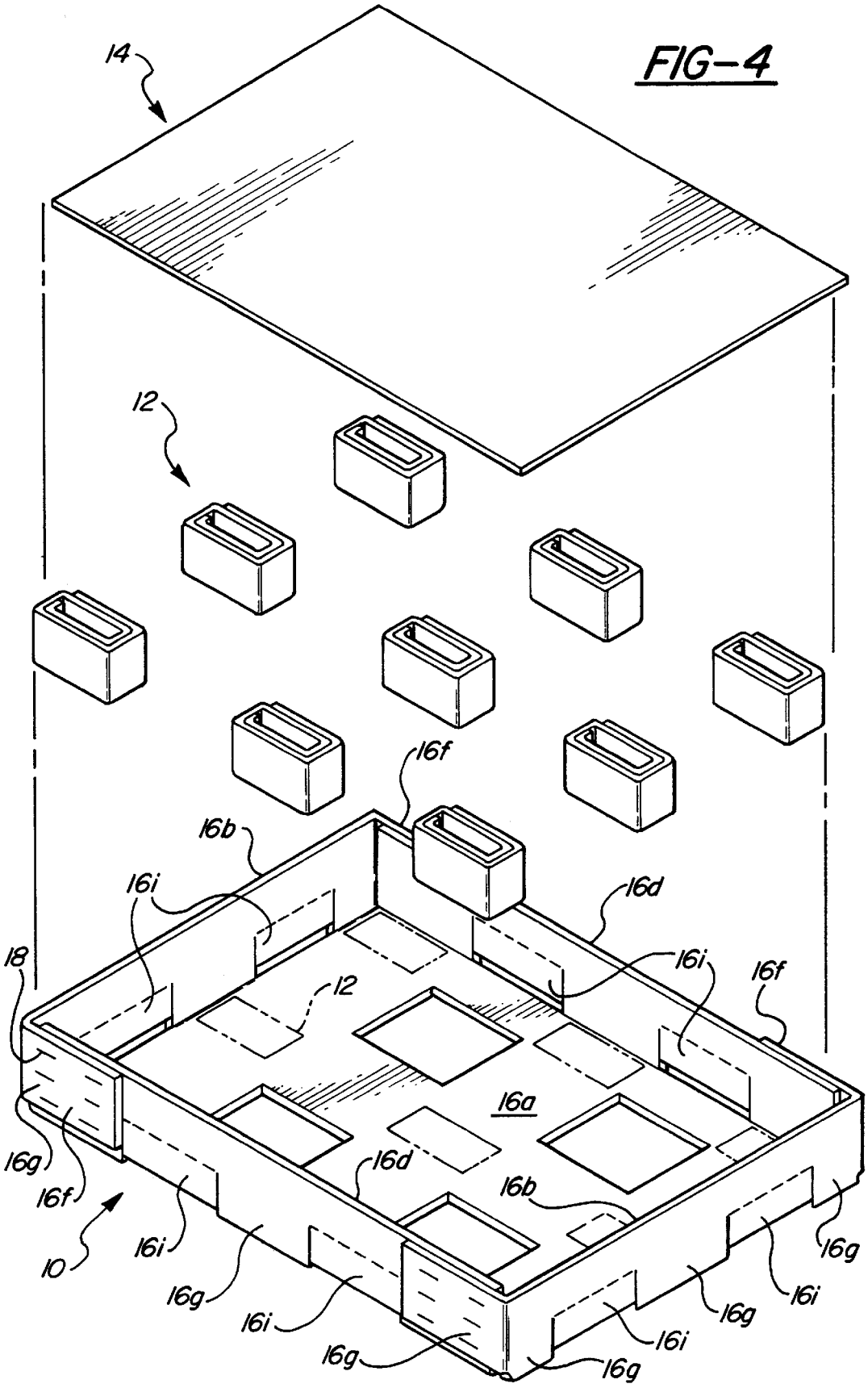
FIG. 4 is an exploded view of the invention pallet.

To form the tray 10 as seen in FIG. 4, side wall portion 16*b* and 16*d* are folded upwardly at crease lines 16*c*,16*e* to form an open box configuration, whereafter end flaps 16*f* are folded over about crease lines 16*g* to overlap end portions of the flaps 16*b*, whereafter staples 18 are utilized to fixedly secure the end flaps to the side walls 16*b* to form the tray.

Figure 3:
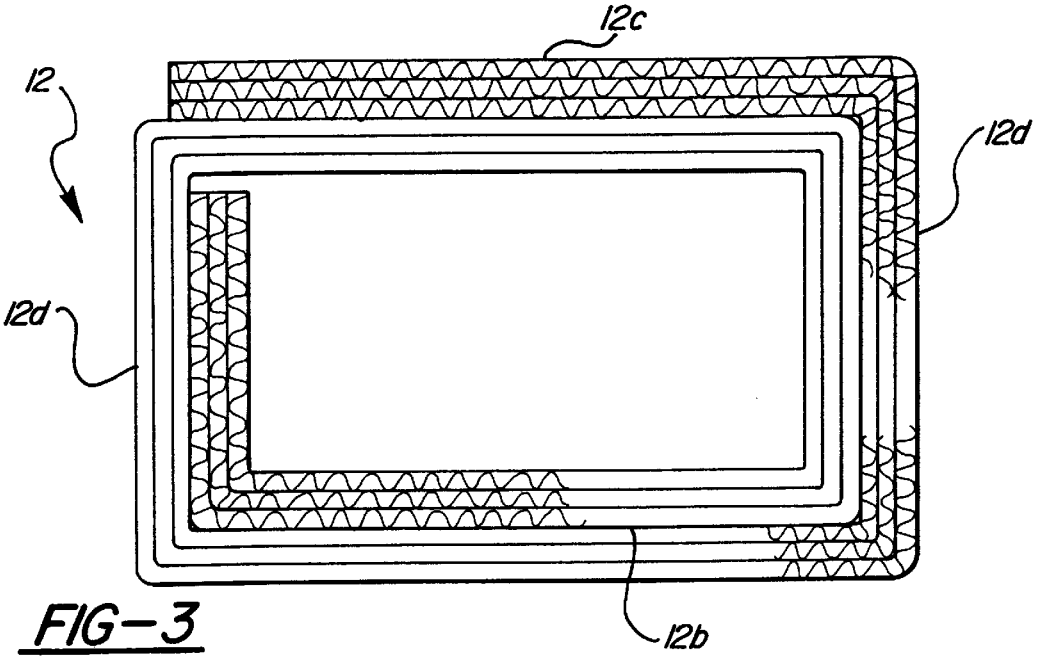
FIG. 3 is a top view of a corrugated cardboard block utilized in the invention pallet.

Each block 12 is formed of a triple wall corrugated cardboard material which is wrapped (FIG. 3) to form a hollow rectangular laminated structure. Blocks 12 are preferably formed by manufacturing laminated rectangular tubes utilizing triple wall corrugated cardboard and then cutting the tubes into individual blocks having the desired height or length.

Panel 14 is preferably formed by double wall corrugated cardboard material and has a rectangular configuration sized to fit within the side walls 16*b*,16*d* of the tray.

To assemble the pallet, and following formation of the tray as previously described, a plurality of blocks 12 are positioned within the tray proximate the side walls at spaced locations about the periphery of the side walls. Each block has a bottom face 12*a* positioned on the bottom wall 16*a* of the tray and an upper face 12*b* lying in a common plane with the upper faces of the other blocks. The blocks have a height that is a fraction of the height of side walls 16*b* and 16*d*. Preferably, a corner block 12 is positioned in each corner of the tray within the side walls 16*b*, 16*d* and an intermediate block 12 is positioned proximate each side wall 16*b*, 16*d* at an intermediate location along the respective side wall. The size and positioning of the flaps 16*i* relative to the placement of the blocks within the side walls is such that a flap 16*i* is positioned between each set of corner and intermediate blocks and extends substantially the full width or spacing between the adjacent blocks. A further block 12 is positioned centrally of the bottom wall 16*a*. Following placement of the blocks on the bottom wall 16*a*, the lower faces 12*a* of the blocks are adhesively secured to the bottom wall 16*a* whereafter panel 14 is positioned within side walls 16*b*,16*d* in overlying relation to the top walls 12*b* of the blocks whereafter the upper faces 12*b* of the blocks are adhesively secured to the lower face of the panel 14. Side wall flaps 16*i* are now folded upwardly and inwardly out of the side walls about crease lines 16*j* to bring the upper or inner face 16*n* of each side wall flap against the underface 14*a* of panel 14, whereafter the flaps are secured to the underface of the panel by gluing or stapling. Since the blocks 12 have a height that is only a fraction of the height of the side walls 16*b*,16*d*, upper side wall portions 16*p* are defined above the upper face 14*b* of panel 14.

In the assembled configuration of the pallet, the upwardly folded flaps 16*i* define a pair of openings 20 in each side wall of the pallet to facilitate the entry of the tines of material handling equipment. The upwardly folded side wall flaps also serve to fixedly lock the side walls to the panel 14 so as to preclude outward bowing of the side walls, and the upwardly folded flaps 16*i* leave solid full height side wall portions 16*q* in outwardly protecting relation to each block. Specifically, the outboard faces 12*c* of each intermediate block are protected by a side wall protective portion 16*q* between adjacent openings 20, and the outboard faces 12*c* and 12*d* of each corner block are protected by side wall protective portions 16*q* adjacent each corner of the tray. Whereas each flap 16*i* may extend the full width between adjacent blocks 12, it may be preferable in some severe material handling environments to have each flap 16*i* extend something less than the full distance between adjacent blocks so as to leave protective edge portions 16*p* (FIG. 7) of the side walls in protective overlapping relation with respect to the faces 12*d* of the blocks so that, if the tines of a forklift truck or the like stray from a center line with respect to the openings 20, the blocks 12 will still not be engaged and dislodged but rather the protective side wall edge portions 16*p* will receive and absorb the damage from the tines. Note in this regard that the folded over end flaps 16*f* provide further protection from dislodgement for the corner blocks 12.

Whereas the pallet of the invention may be utilized by itself to provide a shallow container with material positioned on the bottom wall 16*a* of the tray precluded from dislodgement from the pallet by the upper side wall portions 16*p*, the invention pallet will most typically be utilized as the base member of a palletized container as seen in FIG. 2 including a sleeve 22 formed of a corrugated cardboard material and positioned within the side walls of the pallet and a lid 24 also formed of a corrugated cardboard material and positioned over the upper edges of the sleeve to form and close the container. Whether the pallet is utilized separately or as the base for a palletized container, the openings 16*m* in bottom wall portion 16*a*, in known manner, provide access to the support surface of the pallet to allow the use of pallet jacks.

The pallet of the container will be seen to provide many important advantages. Specifically, the invention pallet retains the lightweight, inexpensive, and readily recyclable characteristics of a corrugated cardboard pallet and yet provides an extremely rigid and strong pallet that, in particular, is extremely resistant to dislodgement of the block members forming the core elements of the pallet.

Whereas a preferred embodiment of the invention has been illustrated and described in detail, it will be apparent that various changes may be made in the disclosed embodiment without departing from the scope or spirit of the invention.

I claim:

1. A pallet comprising:

a tray having side walls and a bottom wall;

a plurality of blocks positioned within the tray proximate the side walls at spaced locations about the periphery of the side walls and each block having a bottom face positioned on the bottom wall of the tray and an upper face lying in a common plane with the upper faces of the other blocks;

a panel positioned within the side walls on top of the blocks; and a plurality of flaps folded upwardly and inwardly out of the side walls between adjacent blocks against the underface of the panel and secured to the underface of the panel, whereby to provide openings in the side walls for the entry of material handling equipment and lock the side walls to the panel while retaining portions of the side walls in outwardly protecting relation to each block.

2. A pallet according to claim 1 wherein the blocks have a height less than the height of the side walls so that upper side wall portions extend above the level of the panel.

3. A pallet according to claim 1 wherein:

the tray has a rectangular configuration defining four side walls and four corners;

a corner block is positioned in each corner of the tray and an intermediate block is positioned proximate each side wall at an intermediate location along the side wall; and a flap is folded upwardly between each corner block and each intermediate block whereby to provide two openings in each side wall for the entry of material handling equipment.

4. A pallet according to claim 1 wherein the tray is formed of a corrugated cardboard material.

5. A pallet according to claim 4 wherein each flap is formed in a side wall of the tray by a crease along an upper edge of the flap and slits along other edges of the flap, whereby to allow the flap to be folded upwardly about the crease.

6. A pallet according to claim 5 wherein each block is formed of a corrugated cardboard material wrapped to form a hollow rectangular laminated structure.

7. A pallet according to claim 6 wherein the panel is formed of a corrugated cardboard material.

8. A container comprising a pallet, a sleeve positioned on the pallet, and a lid positioned over the sleeve, characterized in that the pallet comprises:

a tray having side walls and a bottom wall;

a plurality of blocks positioned within the tray proximate the side walls at spaced locations about the periphery of the side walls and each block having a bottom face positioned on the bottom wall of the tray and an upper face lying in a common plane with the upper faces of the other blocks;

a panel positioned within the side walls on top of the blocks; and a plurality of flaps folded upwardly and inwardly out of the side walls between adjacent blocks against the underface of the panel and secured to the underface of the panel, whereby to provide openings in the side walls for the entry of material handling equipment and lock the side walls to the panel while retaining portions of the side walls in outwardly protecting relation to each block.

9. A container according to claim 8 wherein the blocks have a height less than the height of the side walls so that upper side wall portions extend above the level of the panel.

10. A container according to claim 8 wherein:

the tray has a rectangular configuration defining four side walls and four corners;

a corner block is positioned in each corner of the tray and an intermediate block is positioned proximate each side wall at an intermediate location along the side wall; and a flap is folded upwardly between each corner block and each intermediate block whereby to provide two openings in each side wall for the entry of material handling equipment.

11. A container according to claim 8 wherein the tray is formed of a corrugated cardboard material.

12. A container according to claim 11 wherein each flap is formed in a side wall of the tray by a crease along an upper edge of the flap and slits along other edges of the flap, whereby to allow the flap to be folded upwardly about the crease.

13. A container according to claim 12 wherein each block is formed of a corrugated cardboard material wrapped to form a hollow rectangular laminated structure.

14. A container according to claim 13 wherein the panel is formed of a corrugated cardboard material.

15. A method of forming a pallet comprising the steps of;

forming a tray having side walls and a bottom wall;

positioning a plurality of blocks within the tray proximate the side walls at spaced locations about the periphery of the side walls with each block having a bottom face positioned on the bottom wall of the tray and an upper face lying in a common plane with the upper faces of the other blocks;

securing the bottom faces of the blocks to the bottom wall of the tray;

positioning a panel within the side walls on top of the blocks;

securing the panel to the upper faces of the blocks;

creasing and slitting the side walls of the tray to provide a plurality of upwardly foldable flaps between adjacent blocks;

folding the flaps upwardly and inwardly out of the side walls against the underface of the panel; and securing the flaps to the underface of the panel.

16. A method according to claim 15 wherein the blocks have a height less than the height of the side walls so that upper side wall portions extend above the level of the panel.

17. A method according to claim 15 wherein;

the tray is formed with a rectangular configuration defining four side walls and four corners;

a corner block is positioned in each corner of the tray and an intermediate block is positioned proximate each side wall at an intermediate location along the side wall; and a flap is folded upwardly between each corner block and each intermediate block whereby to provide two openings in each side wall for the entry of material handling equipment.

18. A method according to claim 15 wherein the tray is formed of a corrugated cardboard material.

19. A method according to claim 18 wherein each flap is formed in a side wall of the tray by a crease along an upper edge of the flap and slits along other edges of the flaps, whereby to allow the flap to be folded upwardly about the crease.

20. A method according to claim 19 wherein each block is formed of a corrugated cardboard material wrapped to form a hollow rectangular laminated structure.

21. A method according to claim 20 wherein the panel is formed of a corrugated cardboard material.

* * * * *